US005851291A

United States Patent [19]

Poterala et al.

[11] Patent Number: 5,851,291

[45] Date of Patent: Dec. 22, 1998

[54] CHEMICAL FOAMING MACHINE AND MIXING APPARATUS

[76] Inventors: Robert J. Poterala, 140 Rocky Point, Greenville, S.C. 29615; Joseph G. Poterala, 211 Quail Ridge Dr., Simpsonville, S.C. 29680

[21] Appl. No.: 690,501

[22] Filed: Jul. 31, 1996

[51] Int. Cl.[6] ..... B05C 11/00; B05B 13/02; B01F 7/00

[52] U.S. Cl. ..... 118/612; 118/324; 366/304

[58] Field of Search ..... 422/133; 118/612, 118/410, 324, 663; 417/477.1, 474; 366/150.1, 152.1, 152.2, 160.1, 160.2, 154.1, 101, 102, 105, 106, 304, 338

[56] References Cited

U.S. PATENT DOCUMENTS

| | | | |
|---|---|---|---|
| 315,667 | 4/1885 | Serdinko . | |
| 2,689,374 | 9/1954 | Toulmin, Jr. | 18/12 |
| 2,991,049 | 7/1961 | Clarke et al. | 259/4 |
| 3,926,700 | 12/1975 | Hopkins, Jr. et al. | 428/95 |
| 3,989,470 | 11/1976 | Czurak et al. | 422/133 |
| 4,061,001 | 12/1977 | Von Der Eltz et al. | 118/612 |
| 4,132,838 | 1/1979 | Kreuer et al. | 521/50 |
| 4,394,289 | 7/1983 | Brown et al. | 422/133 |
| 4,644,900 | 2/1987 | Poterala | 118/670 |
| 5,022,838 | 6/1991 | Payne | 156/425 |
| 5,372,486 | 12/1994 | Wehling | 417/477.8 |
| 5,451,104 | 9/1995 | Kleen et al. | 422/133 |
| 5,468,129 | 11/1995 | Sunden et al. | 417/477.12 |
| 5,480,597 | 1/1996 | Ishida et al. | 264/40.4 |
| 5,660,259 | 8/1997 | Hill | 417/474 |

*Primary Examiner*—David A. Simmons
*Assistant Examiner*—Calvin Padgett
*Attorney, Agent, or Firm*—Robert R. Reed; Henry S. Jaudon; Cort Flint

[57] ABSTRACT

This invention relates to a machine for mixing and blending liquid chemicals with a gas or air, and more particularly for providing an air and chemical mixture having the consistency of a foam substance for coating the surface of a fabric or other substrate material. The invention provides a mixing apparatus having a plurality of peristaltic type pumps that operate at a system pressure that will permit pulsed mixing of air with chemical substances without using high system pressures to achieve a predetermined mix ratio for a chemical compound. The addition of a premix unit helps to achieve the mixing by providing a two stage mixing process when used along with a blending foamer. A unique air injector of the premix unit aids in the initial injection of air into the chemical substance. The blending foamer has an improved rotor configuration and mounting to also achieve enhanced mixing. The mixing apparatus provides a foam substance of a chemical compound for coating a substrate material in a coating machine. The mixing apparatus along with the coating machine provides an improved coating system.

46 Claims, 11 Drawing Sheets

CHEMICAL FOAMING MACHINE AND MIXING APPARATUS

BACKGROUND OF THE INVENTION

This invention relates to a machine for mixing and blending liquid chemical substances with an inert gas being air, and more particularly for providing an air and chemical mixture having the consistency of a foam substance for coating the surface of a fabric or other substrate material with a chemical compound.

Foam substances are applied to substrate materials for improving the life and serviceability of the materials. For example, foams are applied to cellular products such as cellular backed carpets and the like to provide a durable non-slip surface resistant to environmental conditions and to make them easy to clean. The disclosure of U.S. Pat. No. 3,926,700 relates to the application of elastomeric urethane resin foams to cellular products, such as the cellular backed carpet, and to the methods for preparing the foams. A mixer provides for the controlled mixing of two components by a number of side by side nozzles in a mixing head with a gas such as air introduced, usually under pressure. In U.S. Pat. No. 4,644,900 a coating machine is disclosed for coating a web of a fabric traveling on a tender. The machine includes a system of turn screws, air cylinders, threaded members and gears to adjust the location of the web being coated. A means for producing the foam to be applied as a coating on the web is not disclosed in this patent.

An essential component of the system for coating a substrate material is the mixing apparatus. The mixing apparatus essentially incorporates air as a gas in complete suspension within the chemical substance. U.S. Pat. No. 2,991,049 discloses a mixing apparatus where air blasts for only a few seconds is sufficient to produce complete mixing of at least two materials in the form of granules of substantially uniform size. In U.S. Pat. No. 2,689,374 a mixing apparatus is disclosed capable of aerating and continuously discharging a rubber dispersion from a tank in a foamed condition. The dispersion of a rubber-like compound may be foamed by the incorporation of gases at atmospheric pressure or higher, such as carbon dioxide, nitrous oxide, propane and equivalent gases. An auger type mixer not only mixes the dispersion but also discharges the aerated mixture.

Many problems are associated with existing mixing apparatus in achieving the desired quality of the foam substance applied to the substrate material. Relative amounts of the chemical substances must be accurately controlled along with the amount of air or gas added to the chemicals. Systems to control the quality of the foamed substance rely on devices which measure the relative quantities of air and chemical substances after they are mixed together. For example, control of the relative amounts of the various chemicals is generally done by weighing the foam substance on a balance scale. Systems have also been designed to use pressure sensors and flow devices available in the industry. In U.S. Pat. No. 4,132,838 an apparatus is disclosed for the production of plastic foams in the form of a Venturi tube. Gas is introduced centrally into the flowing component and is carried along as a jet, and in this way mixed. A constriction or nozzle produces a zone of reduced pressure at a known flow rate and gas is fed into the reduced pressure zone. These systems have observed only limited success in controlling the amount of viscous chemicals used in coating substrate materials.

The mixing apparatus for generating a foam substance generally depends on a single foaming apparatus. Systems with a single component mixing apparatus have been disclosed in U.S. Pat. Nos. 2,689,374 and 4,132,838 discussed previously. In addition, U.S. Pat. No. 5,451,104 discloses a cylindrical mixing chamber for producing foam by pumping a liquid axially into a mixing chamber and introducing air under pressure by way of a gas inlet chamber. Air penetrates through micropores into the mixing chamber to produce a laminar flow of the foam mixture in an axial direction through the mixing chamber. In U.S. Pat. No. 5,480,597 a method is disclosed for blending a gas into a high-viscosity liquid. The flow rate of the pressurized gas discharged into a mixing chamber is controlled as a function of the flow rate of at least one high-viscosity fluid. Instantaneous and pulsed injections of pressurized gas is provided to obtain uniform dispersion in the high-viscosity liquid. A single mixing chamber containing a motorized stirring device with a plurality of blades provides the mixing means. Single component high pressure mixing apparatus do not result in the most efficient systems for providing a quality foam substance.

Additional factors are also of concern in providing a foaming system which can be operated, controlled and maintained with improved ease and efficiency over others in the art. One factor in need of improvement is the amount of chemicals retained in the system when it shuts down, and the effort involved in a cleanup operation. A large retainage volume result in wasted chemicals and operational time. Changing from one chemical to another chemical is also made more difficult with larger volumes retained by the system and required to startup the system. Another factor is the problem associated with operating the system at a high pressure.

The accurate measure of relative quantities of air and chemical substances is difficult in a high pressure system and adjustments in quantities are difficult to regulate. A considerable waste in time and chemicals may result before correct system pressures and flows can be reestablished in a high pressure system. Changes rebound throughout the system and the material volume expands and contracts. In addition, steady state operation is not easily obtained with high system operating pressures. Many systems operate at 100 pounds per square inch and higher. In addition, a long discharge line with a shutoff valve is usually necessary for these systems. A low pressure high volume type of pump is the peristaltic type pump. These pumps have rollers that force a fluid or gas through a hose to provide a pumping action. The disclosures of U.S. Pat. Nos. 315,667; 5,372,486; and 5,468,129 disclose different peristaltic pumps. These pumps use various means to make the roller collapse the hose and pump the material within the hose. Automatic adjustment of the amount of collapse and the unloading of the hose during the coating operation is a critical operational feature not disclosed by these references.

The need exists to have a coating system which will overcome the problems and lack of operational efficiency with present systems in the industry. An apparatus to provide accurate mixing of chemical substances with the inert gas being air is critical for providing the foam substance used in a coating system. The coating system of this invention satisfies this need.

Accordingly, an object of the present invention is to provide accurate and efficient mixing of chemical substances and air volumes by improved low pressure pumping and transporting of the mixed substance, as well as improved control of the flow process.

Another object of the present invention is to improve the quality of the foam substance discharged from the mixing apparatus for improved resiliency, spreadability, viscosity and other physical properties with continued monitoring of the operational components.

Yet another object of the present invention is to produce relatively large volumes of a well mixed foam substance from the mixing apparatus while operated the system at relatively low line pressures.

A further object of the present invention is to improve the mixing apparatus and the foam substance produced by using a two stage mixing process and improved blending devices. All of these improvements are to provide a coating system which is easy to operate, clean and maintain.

SUMMARY OF THE INVENTION

The above objectives are accomplished according to the present invention by providing a mixing apparatus having a plurality of peristaltic type pumps that operate at a system pressure that will permit mixing of air with chemical substances without using high system pressures to achieve mixing. The addition of a premix unit helps to achieve the mixing by providing a two stage mixing process along with a blending foamer. A unique air injector of the premix unit aids in the initial injection of air into the chemical substance. The blending foamer has an improved rotor configuration and mounting to also achieve enhanced mixing. The mixing apparatus provides a foam substance of a chemical compound for coating a substrate material in a coating machine as part of a coating system.

In one embodiment of the invention a mixing apparatus is used with a coating machine for applying a coating compound to a web of a fabric, and the like, while traveling through said machine between first and second spaced apart sides or side enclosures of said machine. The coating machine is of a type which includes a coating table assembly or support assembly for supporting the web and a coating blade assembly or dispenser assembly with a coating trough or dispensing opening between the first and second sides which applies the coating compound onto the fabric traveling along a path. The mixing apparatus comprises an apparatus or component support plate supported by the first side enclosure for housing mechanical components of the apparatus. At least one chemical pump is formed at least in part with the plate and operated for receiving a liquid chemical substance from a chemical feed line and pumping the substance into a chemical feed line supported by the plate. An air pump is formed at least in part with the plate and operated for receiving air from an air supply line and pumping the air into an air feed line. A premix unit is carried within the plate and operated for receiving both the chemical substance from the chemical feed line and the air from the air feed line to initially mix the chemical with the air to form a air-chemical mixture at a predetermined mix ratio and to discharge the mixture into a foamer supply line. A blending foamer is formed at least in part with the plate and operated for receiving the mixture from the foamer supply line and blending the mixture into the chemical compound to provide a foam substance of a consistency to be discharged into a foam discharge line for transfer to the dispenser assembly of the coating machine. Finally, a control system is provided for operating each one of the pumps and the foamer at a relative rotational speed, each one with respect to another, for controlling the consistency of the chemical compound.

In another embodiment of the invention a coating system is provided for uniformly coating a web of a fabric or the like with a coating compound while the web travels along a path. The coating system comprises a coating machine including a dispenser assembly with a dispensing opening and a support assembly for supporting the web along the path. An apparatus support plate is for housing mechanical components of a mixing apparatus. A first chemical pump is formed within the plate and operated at a first rotational speed for receiving a first liquid chemical substance from a first chemical supply line and pumping the substance into a first chemical feed line supported by the plate. An air pump is formed within the plate and operated at a second rotational speed for receiving air from an air supply line and pumping the air into an air feed line. A premix unit is carried within the plate for receiving at least the first chemical substance from the first chemical feed line and the air from the air feed line to initially mix at least the first chemical with the air to form a respective air-chemical mixture. The mixture is at a predetermined mix ratio based on at least first rotational speed compared with the second rotational speed. The premix unit discharges the mixture into a foamer supply line. A blending foamer is formed within the plate and operated at a third rotational speed for receiving the mixture from the foamer supply line and transforming the mixture into the chemical compound. The first compound has a consistency of a foam substance to be discharged into a foam discharge line for piping the foam substance to the coating trough of the coating machine. A control system is for providing at least the first, second and third rotational speeds, each one relative to the other, for controlling the consistency of the foam substance. The coating system provides a coating for said fabric without generally wetting the fabric.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. A coating system is described in this invention to include a coating machine and a mixing apparatus to provide a coating compound for coating a web or substrate material of a fabric and the like. The coating machine has a coating table or support assembly to support the web being coated and a coating blade assembly or dispenser assembly with a coating trough or dispensing opening between first and second side enclosures. The mixing apparatus is supported by the first side enclosure and includes a series of pumps and mixing chambers. The mixing apparatus combines chemical substances with an air or gas to form the coating compound within a blending foamer to have the consistency of a foam substance. The foam substance is discharged into the coating trough for application to the web of the fabric.

Figure 1:
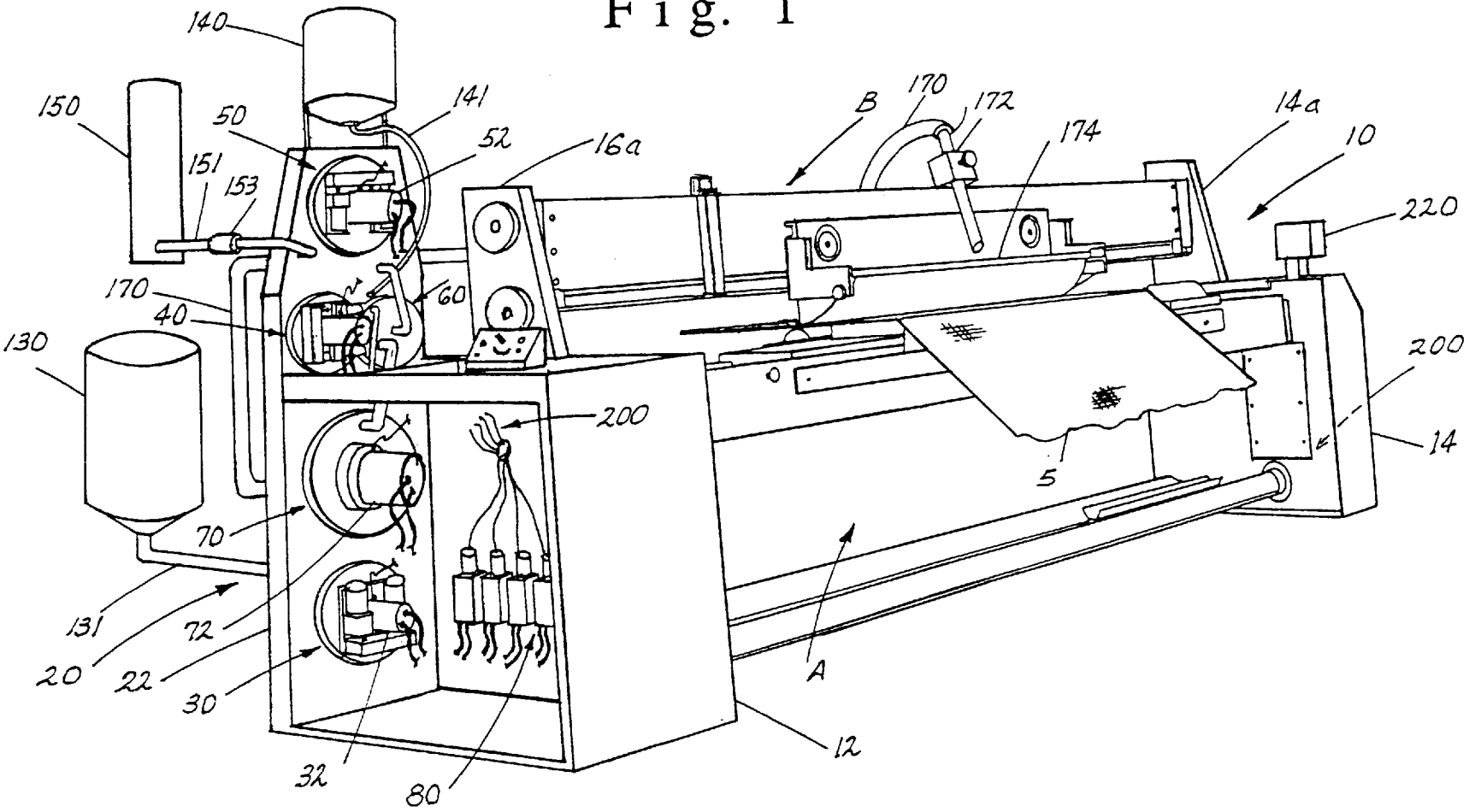
FIG. 1 is a perspective view of the coating system of this invention including a coating machine and a mixing apparatus.

The complete coating system illustrated in FIG. 1 shows a mat 5 traveling along a path through the coating machine. A table assembly A supports the web as the coating blade assembly B applies the foam substance of the coating compound C to the web through the coating trough 174. A foam discharge tube 172 places the foam substance in the through the foam discharge line 170. The foam substance is supplied by the mixing apparatus 20 which is affixed to and supported by the first side enclosure 12 of the coating machine 10. The second side enclosure 14 contains the computerized electrical components of the coating machine including a control panel 220 for adjusting the operating conditions of the mixing apparatus. A thick component support plate 22 provides support for the mechanical components of the mixing apparatus and contains generally circular holes to form an integral part or housing for some of the components, as later described in this disclosure. The preferred size of the plate is 2.5 inches thick having a width of about 2 foot and a height of about 7 foot. The plate is supported by the first side enclosure 12 of the coating machine.

The coating system of this invention is capable of combining one or two chemical substances with air as an inert gas to provide the coating compound. Two chemical pumps are illustrated in FIG. 1 to include a first chemical pump 30 and a second chemical pump 40. A chemical feed tank 130 supplies the first chemical pump through a first chemical feed line 131 and a second chemical feed tank 140 supplies the second chemical pump through a second chemical feed line 141. An air pump 50 provides air to the mixing apparatus from a air supply tank 150 through an air supply line 151. The air supply can use plant air and an air regulator 153 controls the air supply line pressure at the air pump. The preferred air supply line pressure is about five pounds per square inch (psi). A premix unit 60 is also included in the mixing apparatus to receive air and at least one chemical substance for initial mixing of these products to achieve an air-chemical mixture. The air-chemical mixture is fed from the premix unit to a blending foamer 70 which blends the mixture into a foam substance of the coating compound for delivery to the coating machine through the foam discharge line 170.

The chemical pumps 30, 40 the air pump 50 and the blending foamer 70 are all powered by hydraulic motors 32, 42, 52 and 72. These motors provide for improved control in the operation of the mixing apparatus 20 of the coating machine 10 by controlling the relative rotational speeds. Proportional flow valves 80 provide the correct amount of hydraulic fluid flowing to and returning from each hydraulic motor. The speed of each pump is set by the amount of hydraulic fluid flowing to each hydraulic motor from each proportional flow valve. The speed of each chemical pump controls the quantity of chemical being pumped per unit of time and the speed of the air pump also establishes the quantity of air being pumped per unit of time. Controlling these quantities controls the consistency of the foam substance. Electrical signal cables 200 transmit control signals selected by the control panel 220 for predetermined mix ratios by proper operation of the valves 80.

Figure 2:
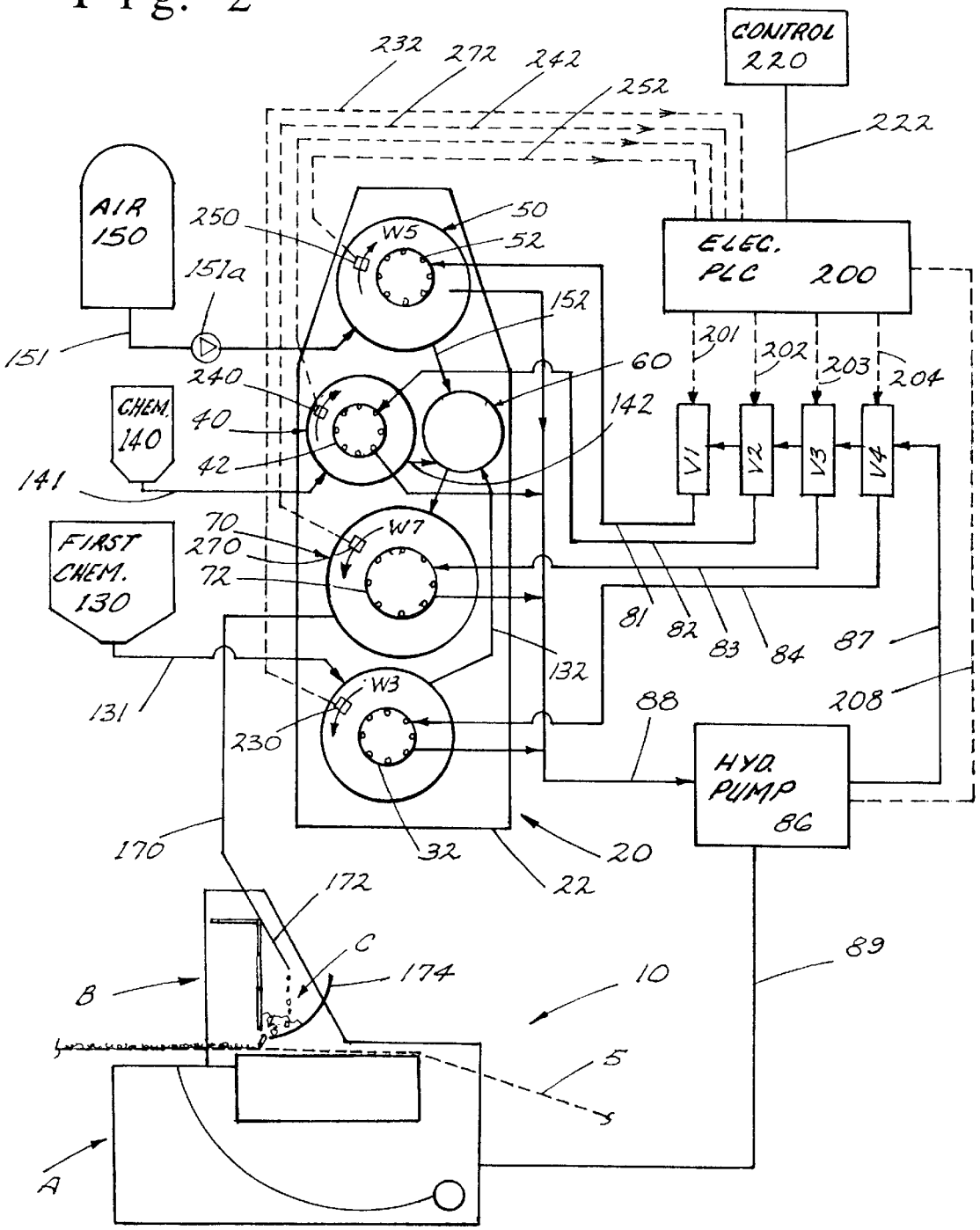
FIG. 2 is a schematic flow diagram illustrating the mechanical components of the foaming system of this invention and their interconnecting lines or cables.

Operational features of the coating system of this invention are illustrated in the coating system flow diagram of FIG. 2. The mixing apparatus 20 contains the essential mechanical components for generating the coating compound C for the coating machine 10. The apparatus or component support plate 22 forms at least in part with and carries the first chemical pump 30, the second chemical pump 40, the air pump 50, the premix unit 60 and the blending foamer 70. A first chemical feed tank 130 supplies the first chemical pump 30 through a first chemical feed line 131 and the first chemical pump discharges a first chemical substance through the first chemical feed line 132 to the premix unit 60. An air supply tank 150 supplies the air pump 50 through an air supply line 151 and the air pump discharges air through the air feed line 152 to the premix unit 60. The premix unit 60 combines the first chemical substance and the air into a air-chemical mixture and discharges the mixture through the foamer supply line 160 to the blending foamer 70. The foamer blends the mixture into a foam substance being a coating compound C discharged through the foam discharge line 170 to the coating trough 174 of the coating blade or dispenser assembly B of the coating machine 10. The mat 5 of the fabric or substrate material is coated as it passes over the table support assembly A of the coating machine.

An additional second chemical substance may be added to form the coating compound in the same manner as the first chemical is included. A second chemical feed tank 140 supplies a second chemical pump 40 through a first chemical feed line 141 and the second chemical pump discharges a second chemical substance through the second chemical feed line 142 to the premix unit 60. For example, the second chemical substance may be a pigment chemical to add color to the coating compound. For the addition of a coloring pigment the quantities are much less than the quantities of the first chemical substance. The additional chemical may be other agents or compounds within the scope of this invention. These agents or compounds may be added to assist the coating compound by improving its physical properties; including drying time, viscosity, spreadability, tack and the like. In addition, the coating system of this invention is a "fast changeover" system.

The hydraulic pumps are driven by hydraulic motors 32, 42, 52, and 72. Hydraulic fluid supply lines 81–84 supply fluid power to operate the motors. Proportional flow valves V1–V4 control the flow of fluid to each motor. A single hydraulic pump unit 86, energized through an electrical power line 208, provides fluid to the proportional flow valves for the hydraulic motors through the fluid power line 87. A return line 88 helps to maintains a closed loop hydraulic system. The hydraulic system is also used to drive other components of the coating machine through a supply line 89. Hydraulic proportional flow valves, hydraulic motors and hydraulic pumps are commonly known in the industry.

The quality and consistency of the coating compound is controlled by the relative amounts of the chemical substances and air used in the compound, as well as the amount of premixing and blending used to form the compound. Each hydraulic motor has a rotational speed which is closely monitored and changed to achieve the desired results. A first chemical pump speed detector 230 monitors a first rotational speed W3 of the first chemical pump 30 for transmission of a first speed signal over a speed signal cable 232. An air pump speed detector 250 monitors a second rotational speed W5 of the air pump 50 for transmission of a second rotational speed signal over a second speed signal cable 252. A blending foamer speed detector 270 monitors the third rotational speed W7 of the blending foamer 70 for transmission of a third rotational speed signal over a third speed signal cable 272. If a second chemical pump is used, a second chemical pump speed detector 240 monitors the fourth rotational speed W4 of the second chemical pump 40 for transmission of a fourth speed signal over a fourth speed signal cable 242. The programming logic controller (PLC) 200 along with the control panel 220 evaluates the speed signals to compare them with a predetermined speed matrix to determine if a correction in any rotational speed is desirable. Electrical correction signals are transmitted through control valve signal cables 201–204 to solonoids within the flow valves V1–V4 respectively to change the flow of hydraulic fluid to each respective motor. Any one or all of the motor speeds can be changed manually by the control panel during a monitoring operation or the system can be operated automatically. A speed matrix can be realized by collecting data on successful coating operations.

Figure 3:
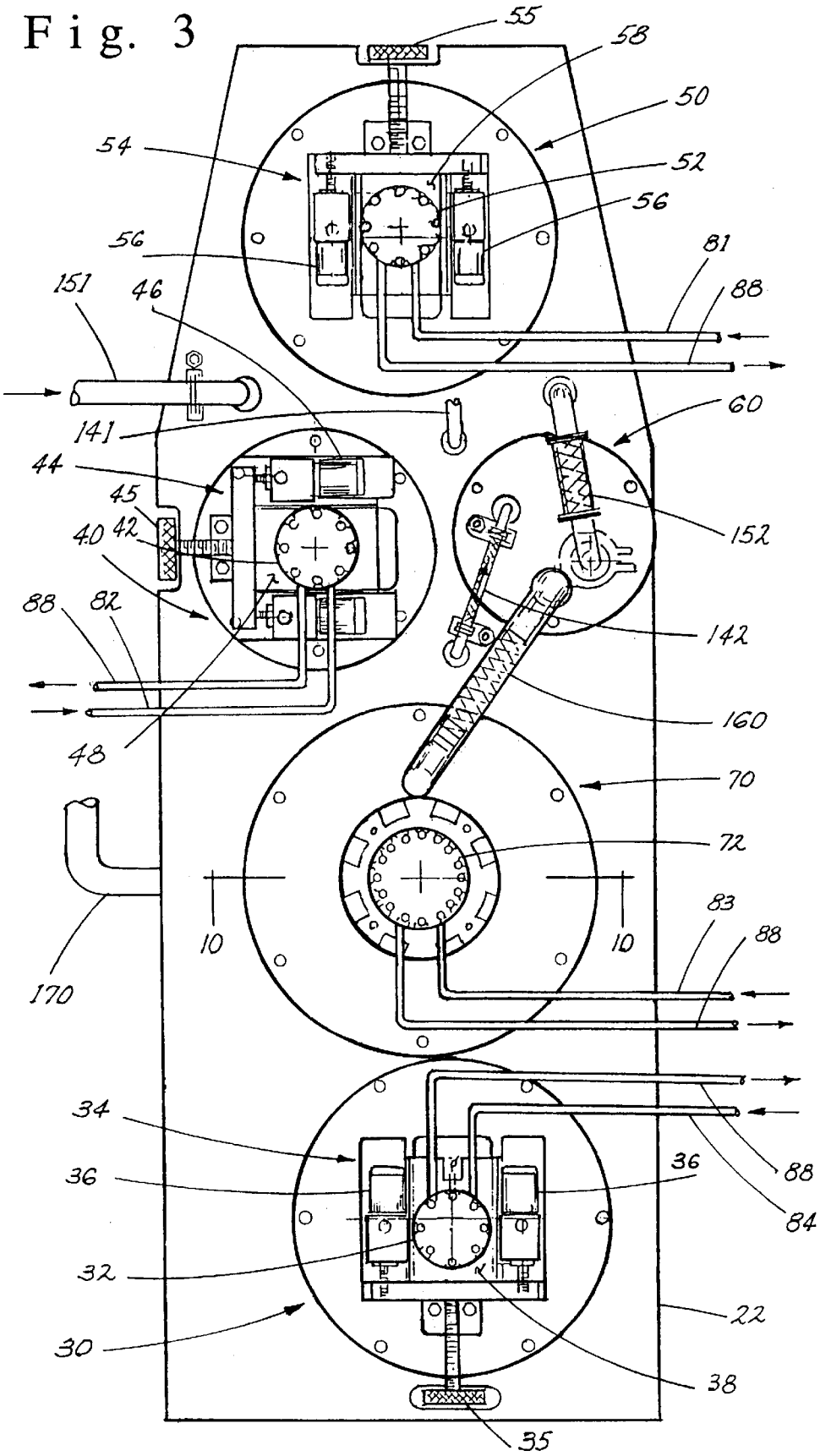
FIG. 3 is a front elevation view of the mechanical components of the mixing apparatus of the invention formed and carried within an apparatus support plate.
Figure 4:
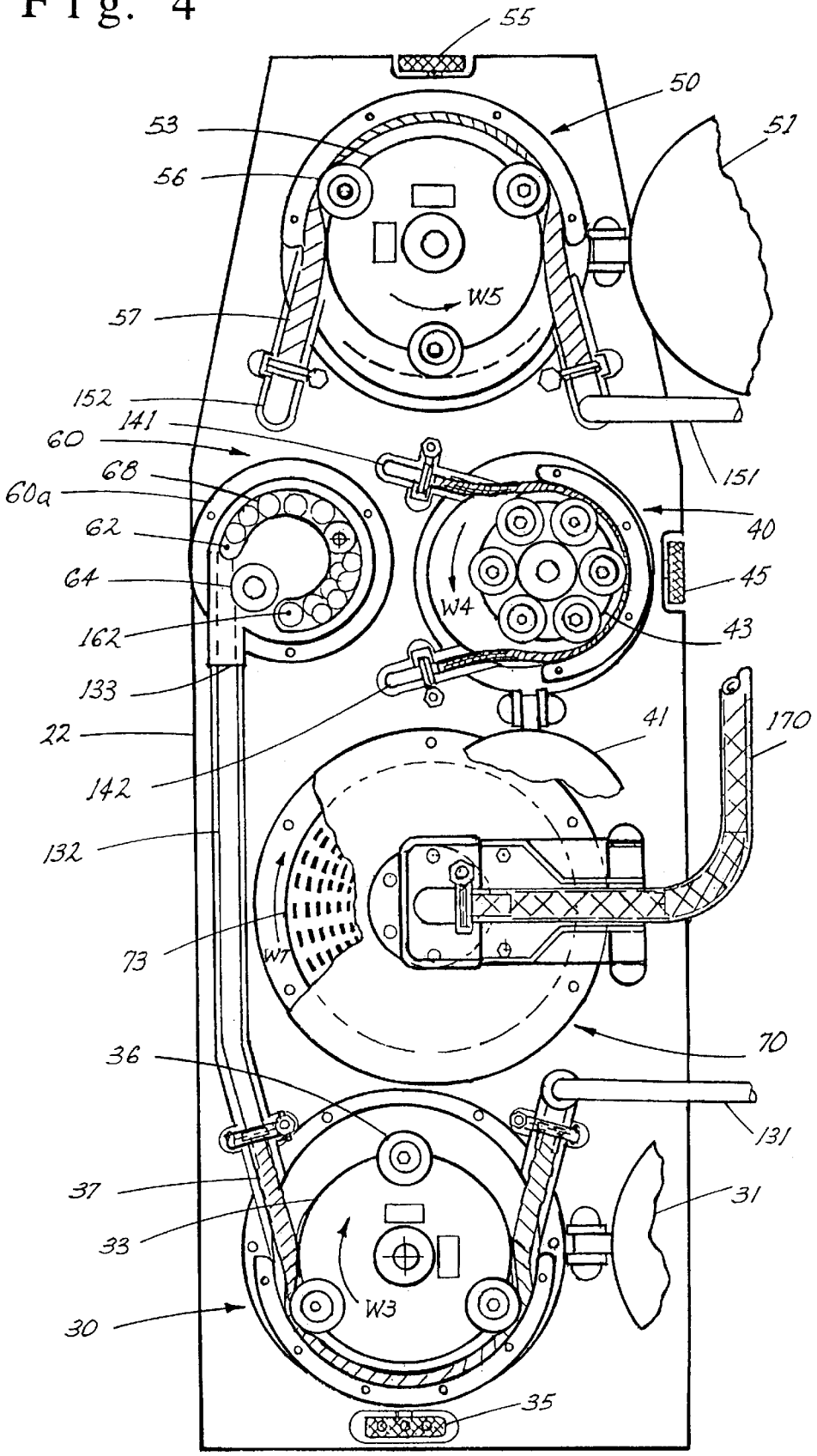
FIG. 4 is a rear elevation view of the mechanical components of the mixing apparatus of the invention formed and carried within the apparatus support plate.
Figure 5:
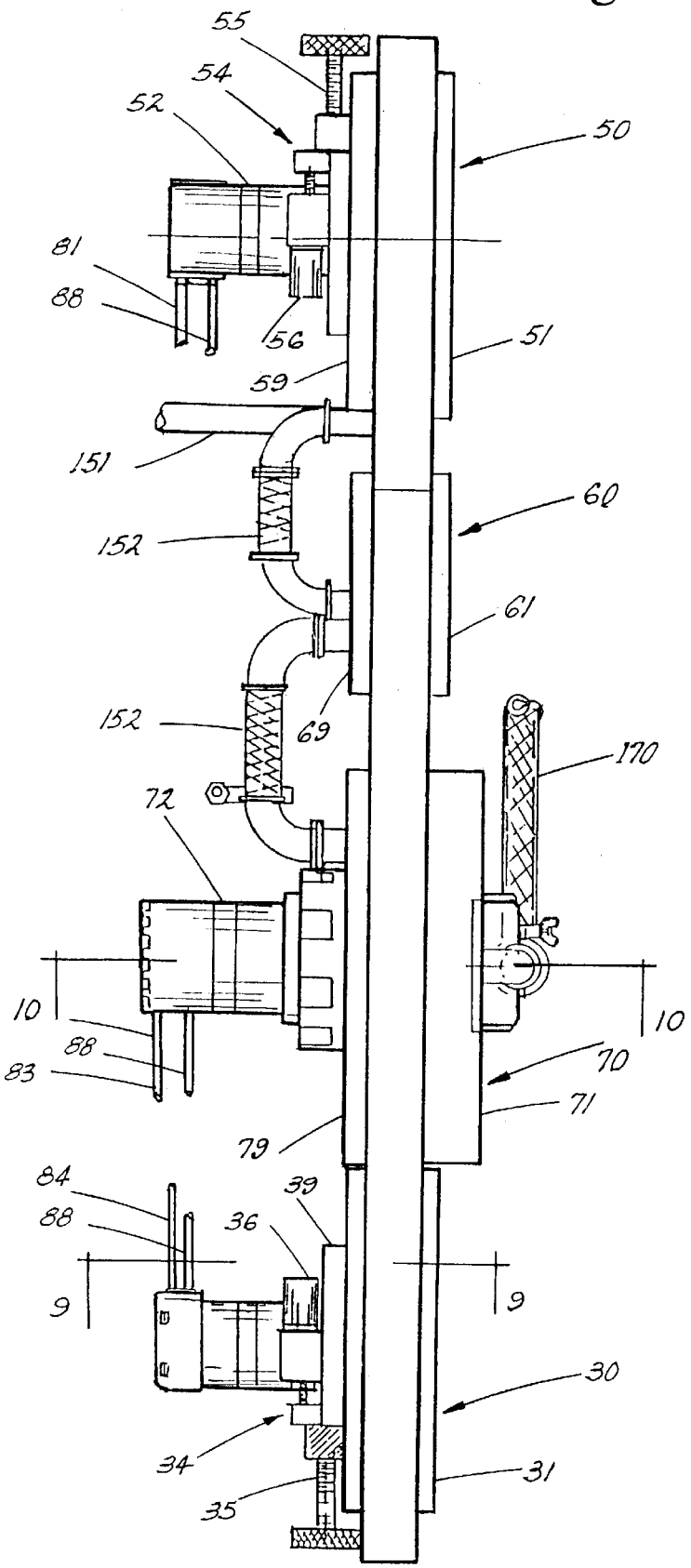
FIG. 5 is a side elevation view of the mechanical components of the mixing apparatus of the invention formed and carried within the apparatus or component support plate.

Additional details of the mixing apparatus 20 are illustrated by a front elevation view of FIGS. 3, a rear elevation view of FIG. 4 and a side elevation view of FIG. 5. The component support plate 22 stands upright and is supported by the first side enclosure 12 of the coating machine 10. The front portion of the support plate faces the inside of the enclosure to protect the hydraulic motors of and enclose, the hydraulic lines supplying the hydraulic motors and electrical cables of the control system.

The front elevation view illustrated in FIG. 3 and the side elevation view of FIG. 5 show additional components of the hydraulic pumps 30, 40 and 50, the premix unit 60 and the blending foamer 70. The first chemical pump 30 includes, in addition to the hydraulic motor 32, a loading assembly 34 with air cylinders 36 for automatically moving a slide plate 38 to adjust the pumping capacity of the first chemical pump, as discussed later. The hydraulic motor 32 is fluid powered by hydraulic supply line 84 and return line 88. The second chemical pump 40 has similar components including the hydraulic motor 42 and a loading assembly 44 with air cylinders 46 for automatically moving a slide plate 48 to adjust the pumping capacity of the second chemical pump. The hydraulic motor 42 is fluid powered by hydraulic supply line 82 an hydraulic return line 88. The air pump 50 also has a similar configuration including the hydraulic motor 52 and a loading assembly 54 with air cylinders 56 for automatically moving a slide plate 58 to adjust the pumping capacity of the air pump. Hand operated screws 35, 45 and 55 can also be used to manually adjust the pumping capability of the pumps 30, 40 and 50 respectively.

The air feed line 152 from the air pump 50 connects to the premix unit 60 along with the second chemical feed line 142 from the front side of the mixing apparatus, as illustrated in FIGS. 3 and 5. The first chemical feed line 132 connects to the premix unit from the rear side, as illustrated in FIG. 4. The blending foamer 70 has its hydraulic motor 72 and foamer supply line 160 connected from the front side as illustrated in FIG. 3. The foam discharge line 170 exits at the rear of the mixing apparatus, as illustrated in FIG. 4. These connections are for the preferred mixing apparatus, but other connection arrangements are within the scope of this invention. In addition, arrangements of the pumps, the premix unit and the blending foamer other than the preferred arrangements illustrated are also possible without changing the operation and function of the system.

Figure 7:
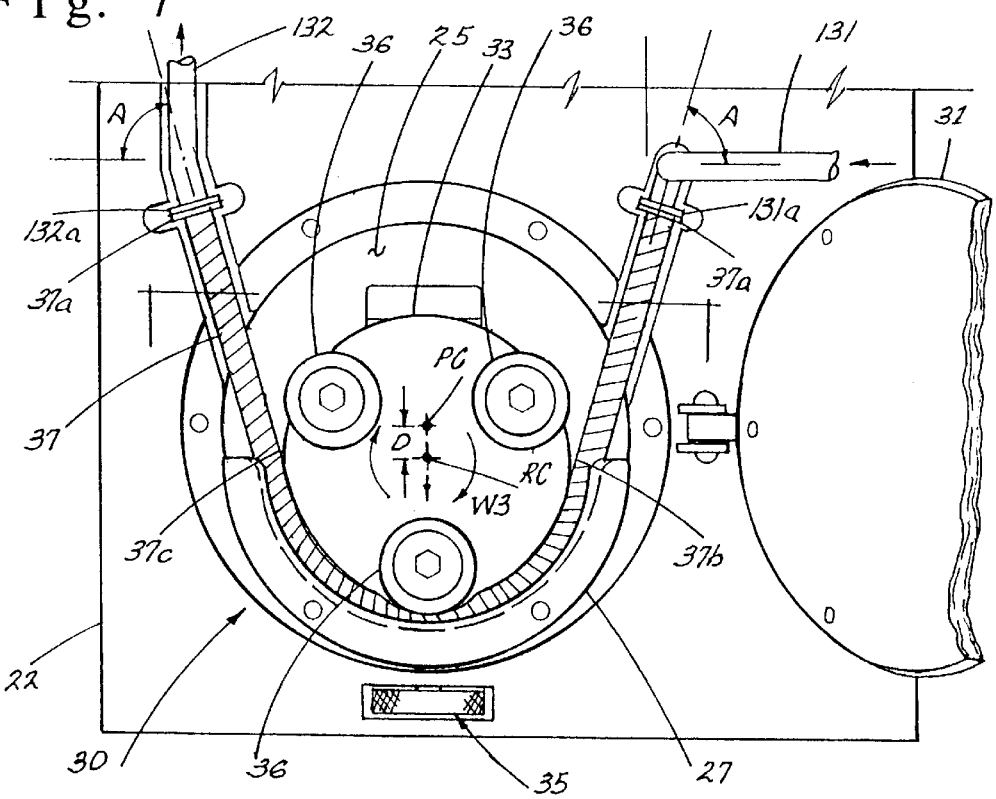
FIG. 7 is a rear elevation view of a first chemical pump of the invention with a rear cover plate displaced to show the interior components of the pump of the mixing apparatus.
Figure 8:
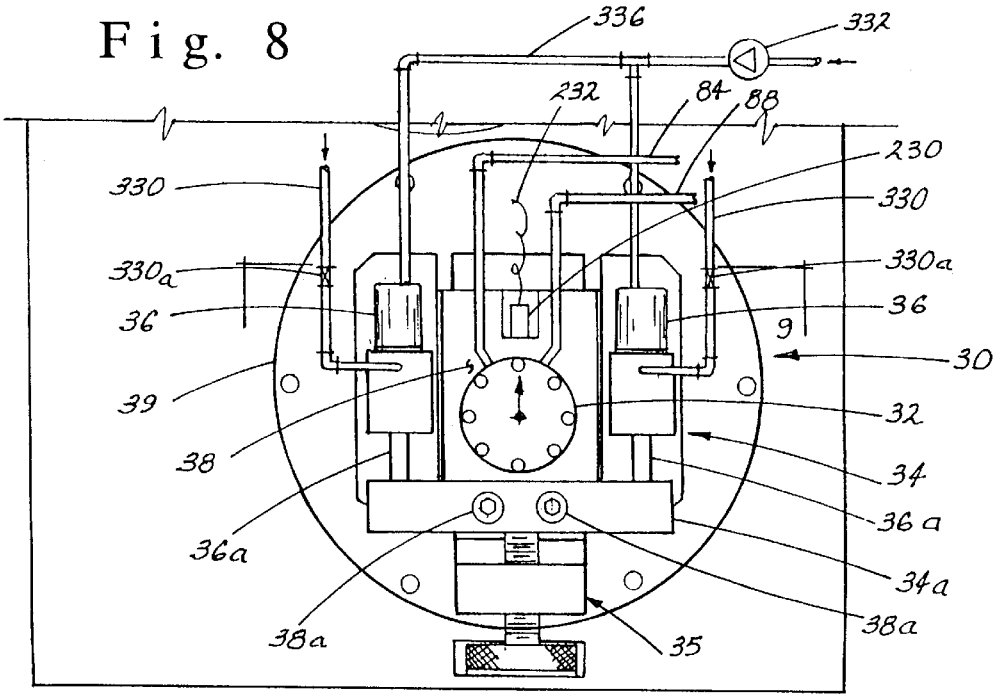
FIG. 8 is a rear elevation view of the first chemical pump of the invention showing the service lines, a first chemical motor and a loading assembly of the mixing apparatus.
Figure 9:
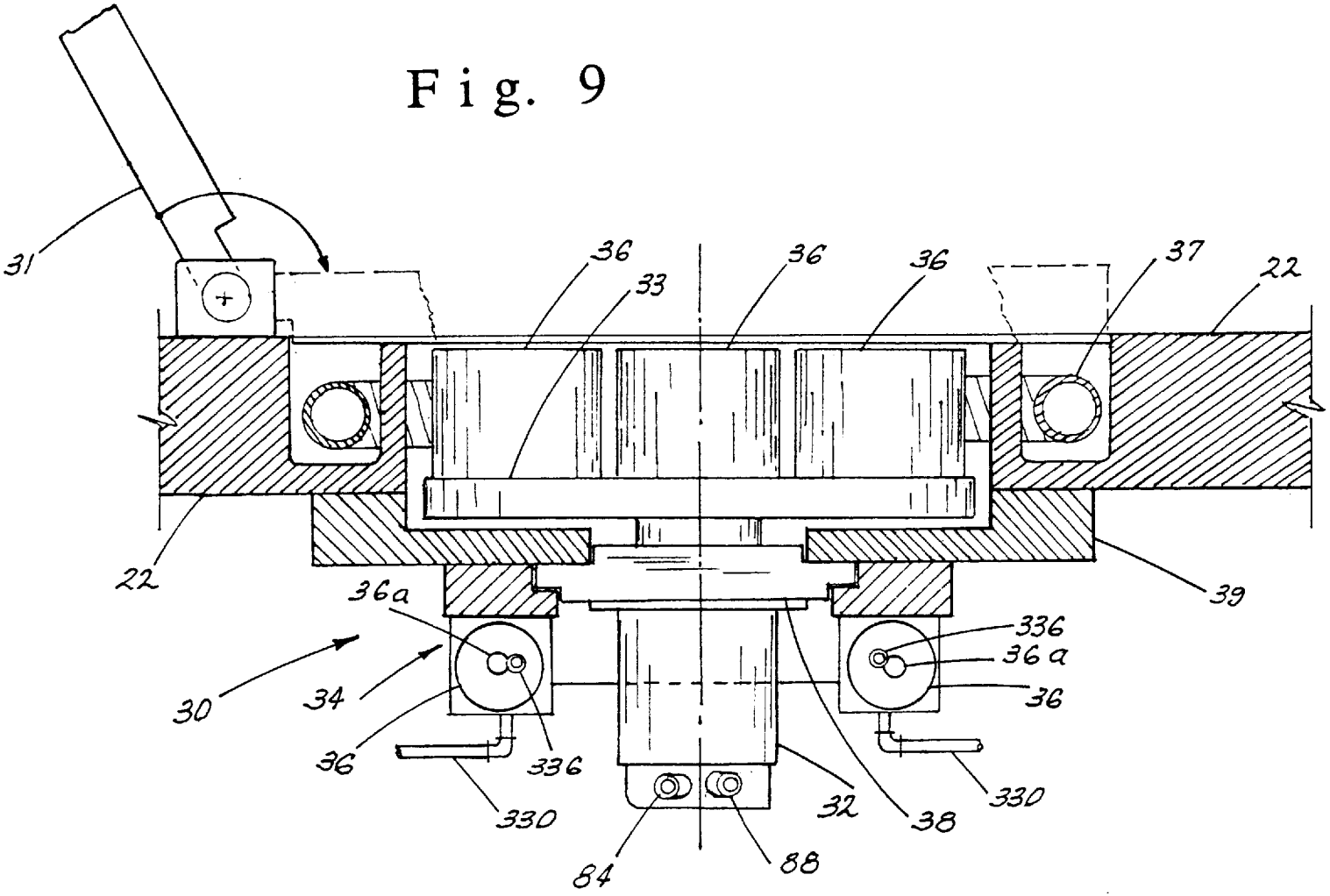
FIG. 9 is a cross-sectional view of the first chemical pump taken along line 9—9 in FIGS. 7 and 8.

The structural features of the interior components of the pumps, the premix unit and the blending foamer are best shown by the rear elevation view illustrated in FIG. 4. The rear cover plates have been opened or removed from the components to schematically show the interior mechanical components. A cutout in the rear cover of the blending foamer is show. The first and second chemical pumps 30 and 40 as well as the air pump are of the peristaltic type. These pumps are commonly referred to as "hosepumps" in the industry. Details of the operation of hosepumps are discussed in the later sections of this discussion including further details of the hosepump designs of this invention, as illustrated in FIGS. 7, 8 and 9.

The rear elevation view of FIG. 4 shows the preferred supply and feed line locations as well as hinged cover locations for efficient use of space on the component support plate and to provide access to the mechanical components for performing maintenance and repair tasks. The first chemical supply line 131 supplies the first chemical pump from this rear side. The first chemical pump 30 has an first chemical feed line 132 extending upward to the premix unit 60. The air pump supply line 151 also supplies the air pump from the rear side; where the air pump feed line 152 extends through the support plate 22 to the front side. Both the second chemical supply line 141 and the second chemical feed line 142 extend through the support plate 22 to the front side of the plate. The foam discharge line 170 extends from this rear side of the support plate to transport the foam substance to the coating trough of the coating machine.

Figure 6A:
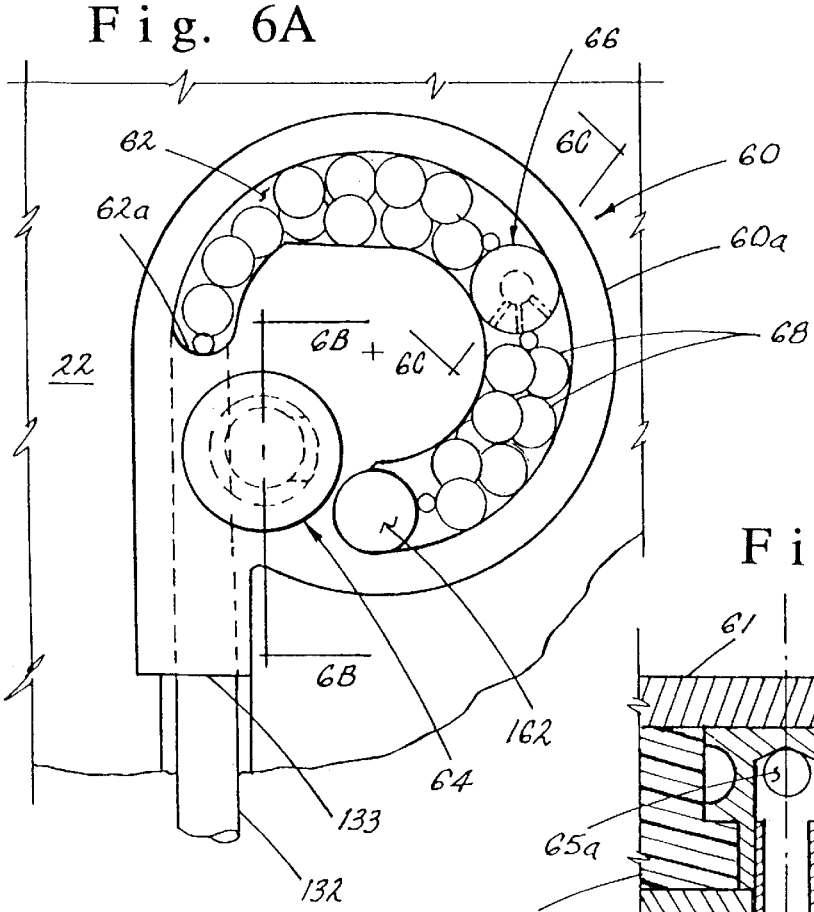
FIGS. 6A–6D are a plan view, two cross-section views and a detail view respectively of a premix unit and its components of the mixing apparatus.

The premix unit 60 is carried within the component support plate 22 by cutting an opening in the plate the size of the premix unit housing **60*a*, as illustrated in FIG. 6A. The first chemical feed line 132 coming from the first chemical pump interfaces with the housing at at first chemical line end 133. Air coming from the air pump 50 is injected into the first chemical by an air inlet device 64 near the line end. The air and first chemical are transported within the housing 60*a* to an premix channel 62 and enter the channel at the premix inlet 62*a*. The premix channel contains a plurality of mix balls 63 held in the channel by retainer posts 62*b* to essentially provide a progression of orifices and expansion chambers between the premix inlet 62*a* and the premix outlet port 162. The first chemical and air exits the premix unit as an air-chemical mixture into the foamer supply line. If a second chemical substance is being added to the mixture, a second chemical feed device 66 is provided to add the second chemical at approximately the mid-point of the length of the channel 62**.

Details of the air feed device 64 and the chemical feed device 66 are unique to this invention, as illustrated in FIGS.

Figure 6B:
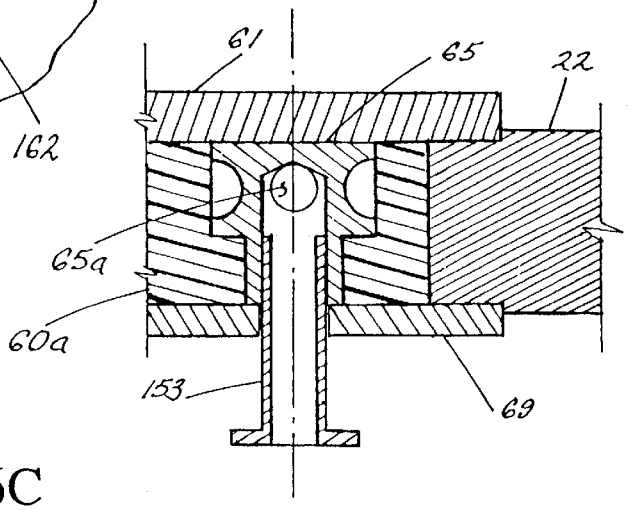
Figure 6C:
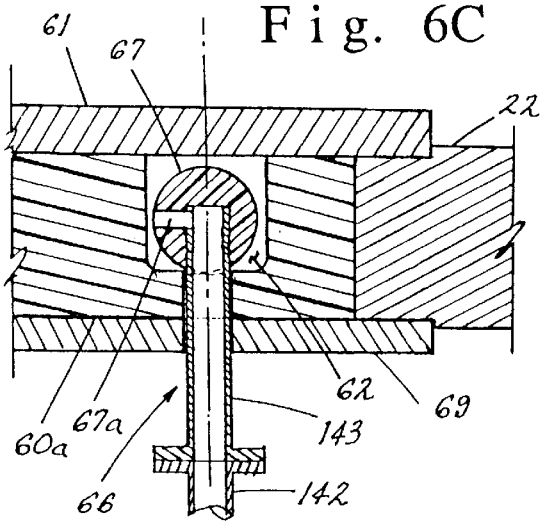
Figure 6D:
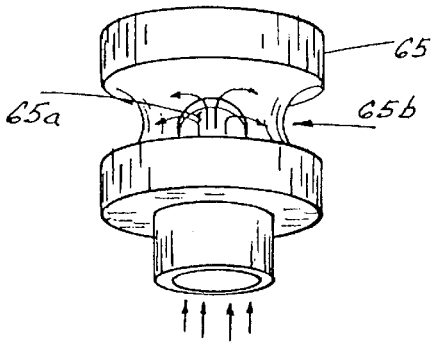

6B–6D. The air feed device is installed in the premix housing 60*a*, as illustrated in cross-sectional view of FIG. 6B, and includes an air injector 65 as illustrated in FIG. 6D. The air injector has center bore and an injector outlet 65*a* directed away from the first chemical supply stream. An injector cutout channel 65*b* feeds the air around both sides of the injector to impact the chemical supply stream along two sides of the air injector. This injection means provides improved initial mixing of the air with the first chemical substance at a relatively low pressure prior to their entrance into the premix channel. The second chemical feed device 66 includes a feed ball 67 attached to the end of a second chemical feed line nozzle 143 of the second chemical feed line 142. The feed ball has a plurality of holes or feed ball bores 67*a* that inject the second chemical substance into the premix channel 62. The unique design of the premix unit 60 results in excellent initial mixing of the chemical substances with the air at a relatively low pressure to provide initial mixing as a first stage of two mixing stages for making the coating compound.

Further details on the structure and function of the peristaltic pumps are essential to the operation of the mixing apparatus. The illustrations of FIGS. 7–9 show the details of the first chemical pump 30 of the invention, which is generally speaking a typical pump of this invention. The other pumps have essentially the same components as those of the first chemical pump. Peristaltic pumps are well known for pumping a relatively large quantity of a liquid when compared with the low line pressure used in these pumps. A peristaltic hosepump of this invention has a plurality of rollers 36 that squeeze air or a liquid through a hose 37 to produce a pumping action. The hose has a ferrule 37*a* on each end to attach the hose to the chemical supply line 131 at one end and the chemical feed line 132 on the other end. Clamps (not shown) are provided to attach the ferrules 37*a* to ferrules 131*a* and 132*a* of the supply and feed lines respectively. The hose can be quickly replaced using the clamps. Preferably the hose is a cord reinforced rubber hose being a standard hose used for durability and resiliency in the industry. Other resilient type hoses can also be used within the scope of this invention.

The component support plate 22 has a generally circular cutout 25 to provide an outer housing for the components of the chemical pump 30. The chemical pump is uniquely formed within the support plate 22 and uses the plate to provide an outer housing. A hose support member 27 is affixed to the support plate within the cutout to receive and support the hose 27 so the hose can be collapsed when engaged by the rollers in their circular path. A roller plate 33 carries the rollers 36 symmetrically positioned around the roller plate to rotate about a roller center axis RC at a rotational speed W3. Preferably, three rollers are used so that a reasonable rotational speed will result in a desired quantity of the first chemical being pumped per revolution of the roller plate. The pumping will be in the form of a pulsed flow of the chemical substance. The pulsed flow improves the mixing operation within the mixing apparatus. The desired flow of the second chemical pump is preferably less than the rotational speed of the first chemical pump. The rotational speed W4 of the second chemical pump is such that six rollers are preferred for the mixing apparatus of this invention (FIG. 4).

The rollers 36 of the chemical pump 30 are loaded against the hose 37 by moving the roller plate 33 to offset the roller center axis RC from a pump center axis PC an offset distance D. The hose 37 approaches the hose support member 27 at a hose angle A on both lateral sides of the pump. The hose angle can have a value in the range of about 10 degrees to about 30 degrees. The preferred value of the hose angle A is about 75 degrees. This angle provides a pair of pinch points 37*b* and 37*c* where the rollers respectively impact and depart the hose during operation of the chemical pump. The endurance of the hose is improved by the use of a hose angle less than 90 degrees. A preferred low inlet pressure of about 5 pounds per square inch is maintained at the pinch point 37*b* on the inlet side of the hose. Inlet pressures keep the hose from having a partial collapse resulting from the resilient hose having a slow rebound time. The inlet pressure allows the pump to produce the same quantity of a material from the action of each roller as it completes its angular pass adjacent the hose support member 27 each revolution of the roller plate 33.

The roller center axis RC is displaced from the pump center axis PC by the pump loading assembly 34, as illustrated in the front elevation view of the chemical pump 30 of FIGS. 8 and 9. The pump loading assembly is affixed to a front cover plate 39 which, in turn, is affixed to the support plate 22. The first chemical pump motor 32 is coupled with the roller plate 33 and aligned with the roller center axis RC. The motor is affixed to a slide plate 38 of the loading assembly 34 and is driven by hydraulic fluid from a supply line 84 to a return line 88. A cross-bar 34*a* of the loading assembly is attached to the slide plate 38 for moving the slide plate relative to the front cover plate 39. A pair of pneumatic cylinders 36 each with a load shaft 36*a* attached to the cross-bar displace the cross-bar 34*a* and slide plate 38 with respect to the pump center PC. The slide plate 38 carries the motor and the roller plate 33 to activate the pumping action of the pump by moving downward to load the rollers 36 against the hose 37 and by moving upward to unload the rollers against the hose.

A pneumatic supply line 336 supplies pneumatic pressure through a pressure regulator 332 to energize the pneumatic cylinders 36. The pressure regulator includes an override device to operate as a safety feature by releasing the load of the rollers on the hose when excessive loads are experienced. Excessive loads are realized by higher pneumatic pressures than during nominal operating conditions. A shop air line 330 has a valve 330*a* that opens in response to the override device being activated. Shop air forces the pneumatic cylinders to unload the rollers from the hose; as the shop air is operated at a higher pressure than the pneumatic pressure. The pneumatic cylinders 36 operate automatically to load and unload the rollers from the hose. A manual load and adjustment device 35 is provided for establishing the proper load realized by the pneumatic pressure and to manually load and unload the rollers from the hose when the automatic loading feature is not being used.

Figure 10:
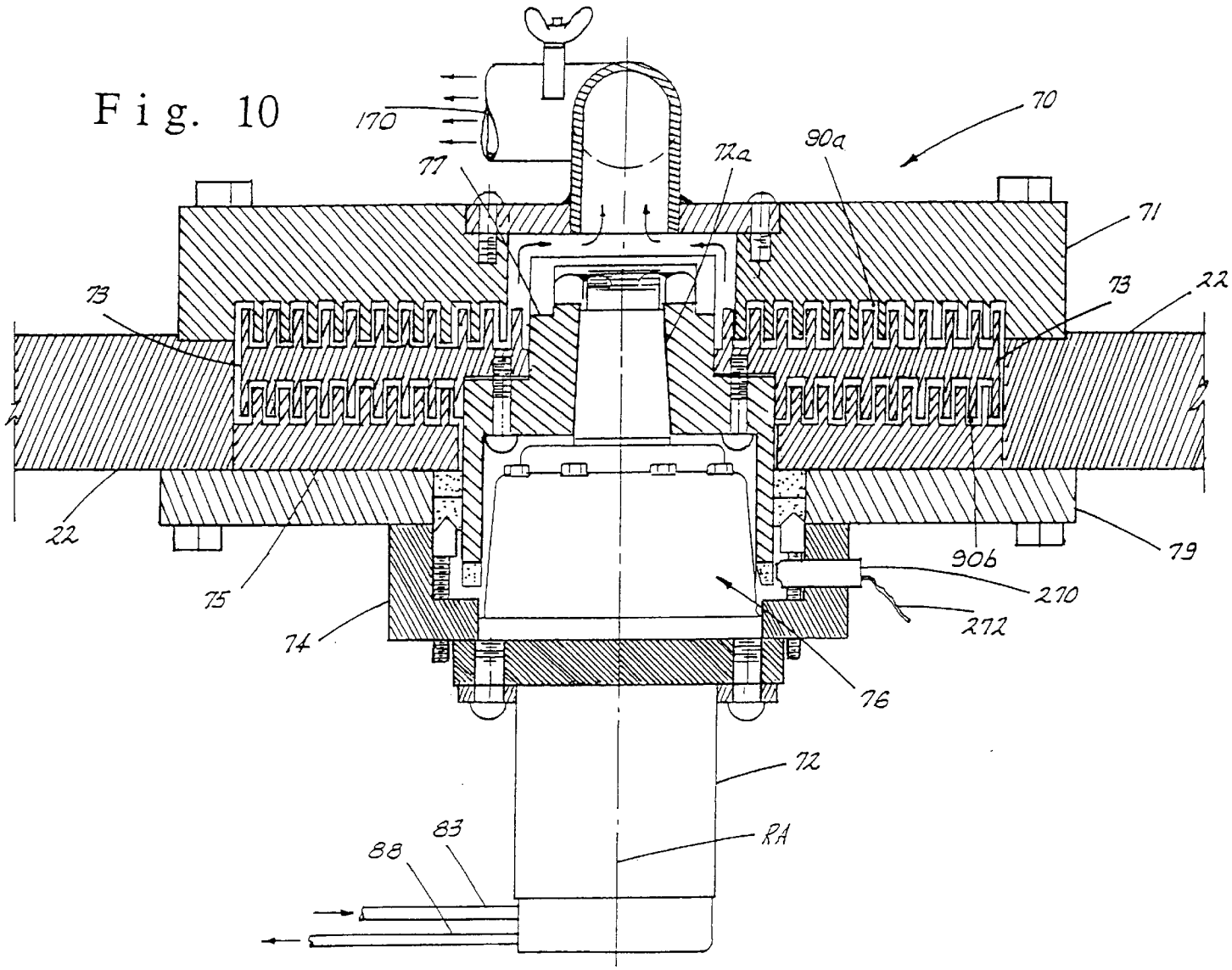
FIG. 10 is a cross-sectional view of a blending foamer of the mixing apparatus taken along line 10—10 in FIG. 4.

An essential component of the mixing apparatus is the blending foamer which provides most of the blending of the air with the chemical substances to make a foam substance. The cross-sectional view of the blending foamer is illustrated in FIG. 10. This cross-section is taken along line 10—10 of FIGS. 3–5. The foamer has two blending interfaces 90*a* and 90*b* each with a plurality of tabs arranged in circular arrays that mesh with each other and have a relative rotational movement from one array to the next at each interface (FIG. 11C). A moving rotor 73 located to the inside of the foamer provides the blending energy for making the air-chemical mixture into a foam substance. The moving rotor 73 is affixed to an attachment fixture 77 that is attached to and rotated by a foamer motor shaft 72*a* of the hydraulic foamer motor 72. The motor is affixed to a foamer adapter member 74 which is attached to a front cover plate 79 carried by the component support plate 22.

A plurality of tabs 93*a* on a surface to the rear of the rotor 73 mesh with a plurality of other tabs 91 formed on the interior surface of the foamer rear cover plate 71 at the rear blending interface 90*a*. A plurality of tabs 93*a* on a surface to the front of the rotor mesh with a plurality of other tabs 95 formed on a surface of a fixed rotor 75 at the front blending interface 90*b*. The air-chemical mixture from the foamer supply line 160 (FIG. 3) enters the interior interfaces of the foamer at a radial outermost location of the fixed rotor 75. Blending of the mixture occurs by shearing action as well as expansion and contraction within the interfaces and a foamed substance being the coating compound exits the foam discharge line 170 as shown by the arrows.

Figure 11A:
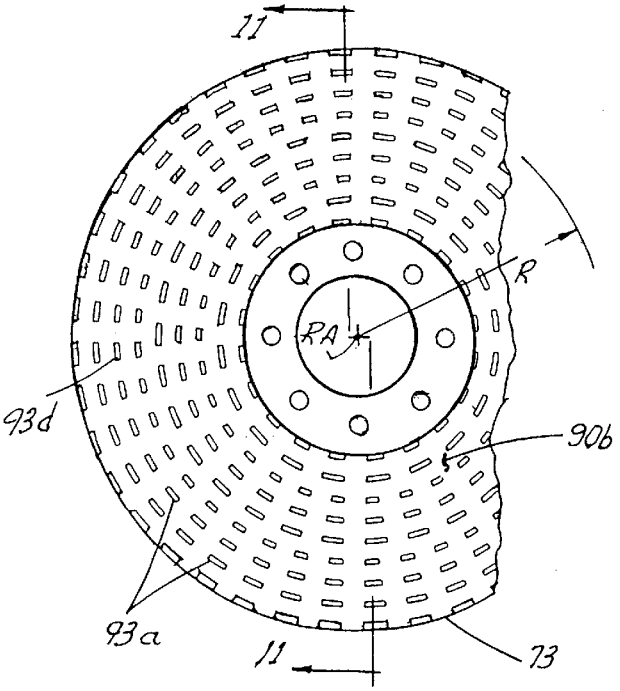
FIGS. 11A–11B are rear side elevation and cross-sectional views respectively of a moving rotor of the blending foamer.
Figure 11B:
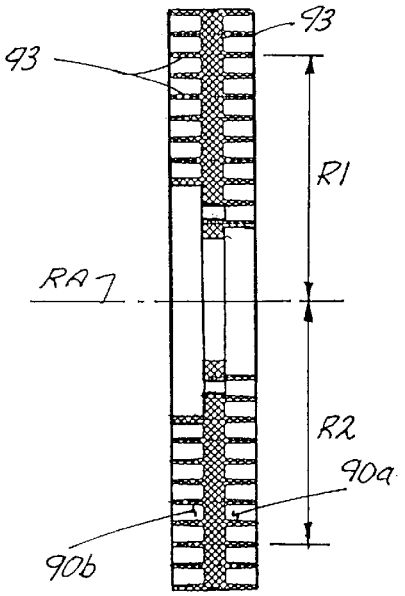

Details of the rotor surfaces including the location of the tabs are important considerations in the enhanced mixing ability of the blending foamer of this invention. An elevation view of the inner surface of the moving rotor 73 is illustrated in FIG. 11A. Concentric rows of tabs 93*b* are placed on the surface to mesh with tabs 95 of the fixed rotor 75. The location, size and spacing of the tabs have been selected to enhance the blending process. The cross-sectional view of Fig. 11B is taken along line 11—11 of FIG. 11A. It is noted that the arrangement of tabs is similar for both sides of the moving rotor. The same general pattern is also used for the inner surface of the foamer rear cover plate 71 and the rear facing surface of the surface of the fixed rotor 75 to mesh with the moving rotor 73.

Another unique feature of the present blending foamer is the blending realized by using an offset or eccentricity E in the tab arrangement for the moving rotor 73. That is, the radius R to any circular array of tabs changes as one moves 360 degrees around the circular array. In other words, a circular array of tabs has its center offset from the rotor axis RA of the moving rotor. That is, R1 is not equal to R2 for tabs 180 degrees apart, as illustrated in FIG. 11B. At the same time the fixed location tabs 91 and 95 are symmetrical with respect to the rotor axis RA.

Figure 12:
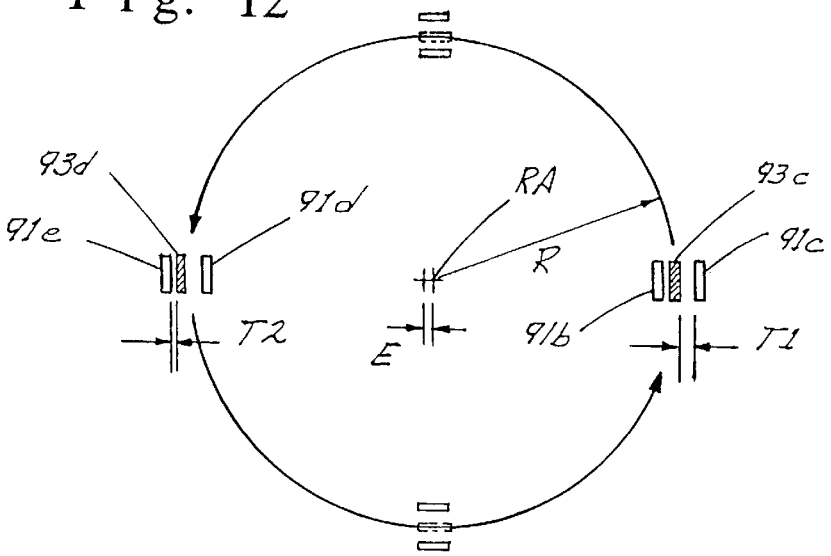
FIG. 12 is schematic diagram of the rotor tabs of the blending foamer as they rotate with respect a the fixed tabs at a blending interface.

The illustration of FIG. 12 shows the relative position between fixed location tabs 91*b* and 91*c* and the tab 93*c* of the moving rotor 73 at a first rear interface 90*a* location. At the same time, the relative position is different between fixed location tabs 91*d* and 91*e* and the moving tab 93*d* at a second rear interface location 180 degrees removed from the first location. Two different tab spaces T1 and T2 are identified at the first and second rear interface locations respectively. Material trapped in the tab space T1 on one side by tab 93*c* will be become squeezed by other rotating tabs of rotor 73 and finally tab 93*d* moves to contact the same material when the moving rotor rotates 180 degrees at some later time. The tab space T1 will be reduced to a tab space of only T2 at this later time. The reverse will then occur back to tab space T1 again as the moving rotor continues from 180 degrees to 360 degrees to complete one revolution of the rotor 73. This action provides another mixing motion not present in a blending foamer having a concentric circular arrays of tabs 93. The rotor 73 can also be mounted to have its center offset from the foamer motor axis RA a distance E to provide the same eccentricity to the circular arrays of tabs 93. Either a concentric rotor tab configuration or an eccentric rotor tab configuration is within the scope of this invention as needed for a particular coating compound.

Figure 13A:
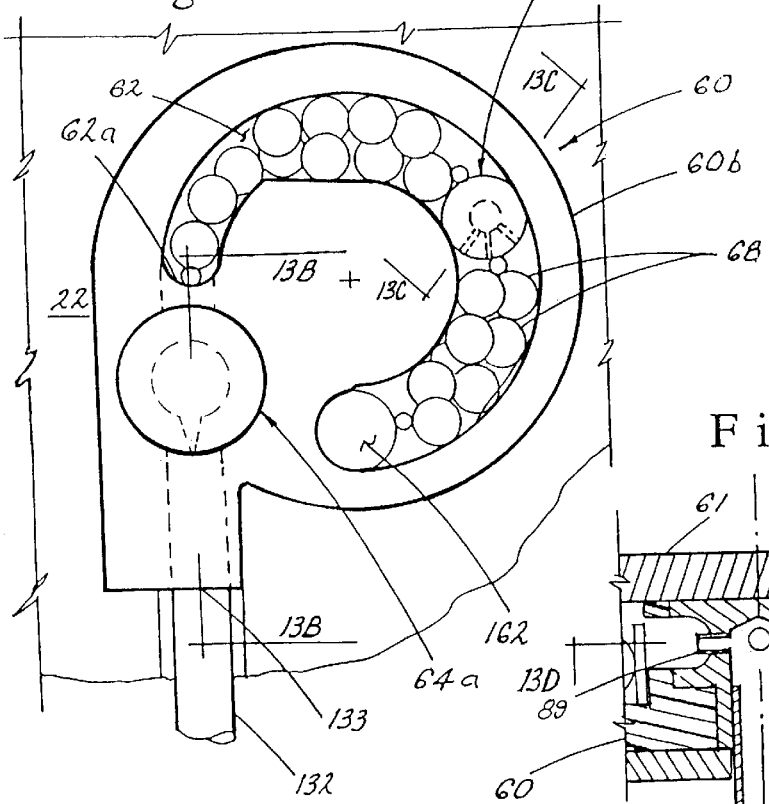
FIGS. 13A–13C are a plan view and two cross-sectional views of an alternate premix unit and an alternate air injector respectively of this invention.
Figure 13B:
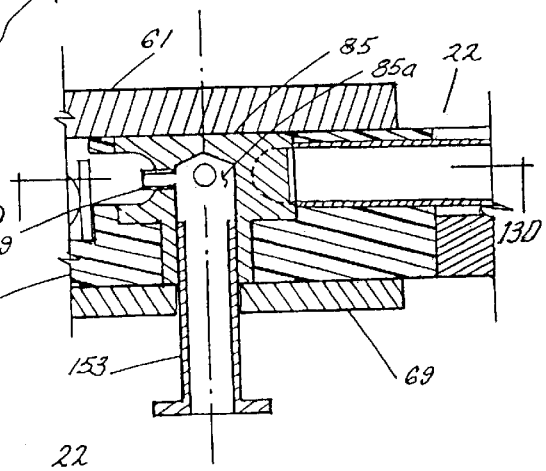
Figure 13C:
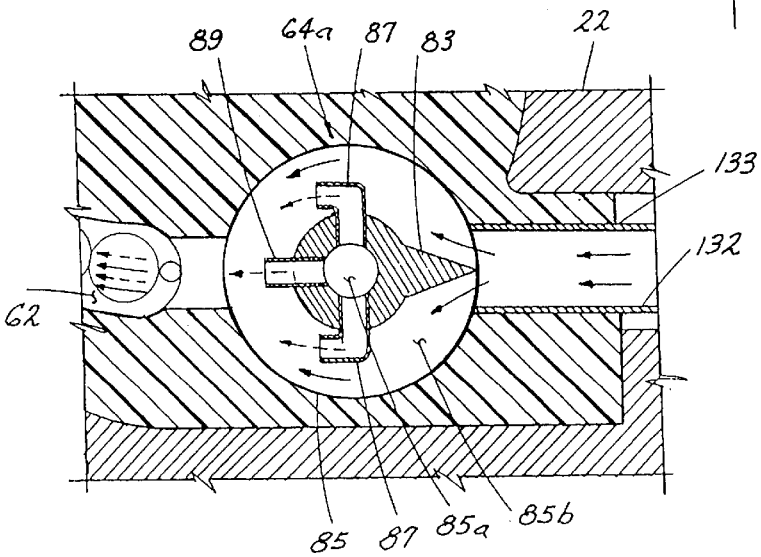

A alternate embodiment of the premix unit includes a alternate air feed device located directly inline with the first chemical feed line, as illustrated in FIG. 13A. The premix housing 60*b* has been enlarged to locate the alternate air feed device 64*a* directly downstream of the end 133 of the chemical feed line 132. Other components of this embodiment of the premix unit 60 are essentially the same as previously described including the premix channel 62 and the second chemical feed device 66. The cross-sectional view, illustrated in FIG. 6B, is taken along the line B1—B1 through the alternate air feed device 64*a*.

The alternate air feed device of this embodiment includes second air injector 85 having generally the same size as the air injector 65 previously described. The second air injector essentially performs the same function of injecting air into the first chemical substance. The air injector has a wedge shaped portion 83 on its upstream side, as illustrated in the cross-section view of FIG. 6C taken along line D—D in FIG. 6B. This wedge portion helps split the first chemical substance into two streams, as shown by the solid arrows. The second air injector further includes a premix inlet 85*a* for bringing air into the injector and a plurality of nozzles for discharging the air into the chemical streams. A pair of lateral nozzles 87, being one on each lateral side, and a dowmstream nozzle 89 helps the air stream, shown by dashed arrows, combine with the chemical streams.

The pulsed pumping action of the first chemical pump 30 and the air pump 50 once again helps the streams to mix. In addition, a negative pressure is developed at the outlet of the lateral nozzles due to the flow of the first chemical substance past these nozzles. This negative pressure helps pull air into the mixing streams. This alternate premix unit can provide improved mixing with certain chemical compounds where the previously described premix unit may be better for other compounds.

The mixing apparatus of this invention can be used for general mixing of two or more chemical substances within the scope of this invention. This can also be achieved without the addition of air. The relative rotational speeds of the first chemical pump and the second chemical pump along with the rotational speed of the blending foamer can be set to generally achieve mixing. General mixing using a plurality of peristaltic pumps at relativey low output pressures has been demonstrated by this invention to generally achieve excellent blending of chemical substances. It is also possible to blend certain powders as well as powders with liquids using the components of this invention.

In one example, the mixing apparatus has been reduced to practice in providing a laboratory coating compound. The compound was formed using a latex for the first chemical substance combined with air. The apparatus provided a foam substance of the coating compound to be used for coating one side of a fabric material with latex to make the material opaque. The system had an output of 5 gallons per minute with the ratio of air to compound providing a mixture ratio of about 5 to 1. The first chemical pump was approximately 14 inches in diameter operated at a first rotational speed of about 15 revolutions per minute. The second chemical pump was not needed for this laboratory application. However, color could have been added to the coating compound by using small quantities of a pigment substance supplied by the second chemical pump. The air pump was also about 14 inches in diameter and was operated at different second rotational speeds from about 60 to about 70 revolutions per minute to observe variations in the properties of the foam substance. The latex and air were supplied to a premix unit having a diameter of about 8 inches. The premix unit discharged an air-latex mixture to the blending foamer. The blending foamer was about 16 inches in diameter and was operated at a third rotational speed of about 150 revolutions per minute. The mixing apparatus produced the foam substance with accuracy and the discharged product had a quality which was according to specifications. The system was started and stopped with ease and cleanup was a simple task with only a few gallons of the coating material going to waste.

While a preferred embodiment of the invention has been described using specific terms, such description is for illustrative purposes only, and it is to be understood that changes and variations may be made without departing from the spirit or scope of the following claims.

What is claimed is:

1. A coating machine, including a mixing apparatus, operative to apply a coating compound to a fabric web traveling through said machine along a path between first and second spaced sides of said machine, said coating machine including a coating table assembly for supporting said web and a dispenser assembly with a coating trough located between said first and second sides which applies said coating compound onto said fabric traveling along said path, said mixing apparatus comprising:

a first side enclosure including a component support plate on a first side of said coating machine housing mechanical components of said mixing apparatus;

said mechanical components include at least one chemical pump mounted within said enclosure, said pump operated for receiving a liquid chemical substance from a chemical supply line and pumping said substance into a chemical feed line;

an air pump receiving air from an air supply line and pumping said air into an air feed line;

a premix unit positioned and arranged to receive both said chemical substance from said chemical feed line and said air from said air feed line for initially mixing said chemical substance with said air to form a air-chemical mixture and to discharge said mixture into an inlet of a foamer supply line;

a blending foamer for receiving said mixture from an outlet of said foamer supply line and blending said mixture into said chemical compound of foam substance of a consistency dischargable into a foam discharge line for transfer to said dispenser assembly of said coating machine; and a separate control system for said mixing apparatus integral with said coating machine for operating each of said pumps and said foamer at individually selected rotational speeds for controlling said consistency of said chemical compound.

2. The apparatus of claim 1 wherein said premix unit and said blending foamer provide a predetermined mix ratio defined by the volume of said gas divided by the volume of said chemical substance of said coating compound being discharged per unit of time from said blending foamer into said dispenser assembly, said mix ratio being in a range from about 2/1 to about 6/1.

3. The apparatus of claim 1 wherein said component support plate mounts said at least one chemical pump which is a peristaltic pump including:

a resilient chemical hose connecting said chemical supply line with said chemical feed line and containing said first chemical substance;

a hose support member affixed to said resilient component support plate to receive said hose in a position for pumping said first chemical substance;

a plurality of rollers carried by a roller plate for progressively collapsing said resilient hose against said hose support member to force said chemical substance through said resilient hose from said chemical supply line to said chemical feed line;

a hydraulic motor connected to said roller plate for rotating said roller plate at a first rotational rate to provide a pumping action of said chemical pump;

a loading assembly connected to the roller plate for controlling the amount of said collapsing of said hose to provide a predetermined volume of said chemical substance being pumped for each revolution of said chemical pump; and a front cover plate and a rear cover plate of said chemical pump both affixed to opposite sides of said component support plate to enclose at least said hose and said plurality of rollers to form said first peristaltic pump.

4. The apparatus of claim 3 wherein said air pump is a peristaltic pump including:

a resilient air hose for connecting said air supply line with said air feed line and containing said air;

an air hose support member affixed to said component support plate to receive said air hose in a position for pumping said air;

a plurality of rollers of said air pump carried by a roller plate for collapsing said hose against said air hose support member to force said air through said resilient air hose from said air supply line to said air feed line;

a hydraulic motor of said air pump connected to said roller plate for rotating said roller plate at a selected second rotational rate to provide a pumping action of said air pump;

a loading assembly connected to said roller plate for controlling the amount said hose collapsed by said rollers to provide a predetermined volume of said air being pumped for each revolution of said air pump; and a front cover plate and a back cover plate of said air pump both affixed to opposed sides of said component support plate to at least enclosed said hose and said plurality of rollers of said air pump to form a second peristaltic pump.

5. The apparatus of claim 4 including:

said resilient chemical hose of said at least one chemical pump having a first inlet pressure maintained at a location adjacent a first pinch point at a low value of about 5 pounds per square inch to maintain said hose of said chemical pump in an expanded configuration; and said resilient air hose of said air pump having a first inlet pressure maintained at a location adjacent a first pinch point at a low value of about 5 pounds per square inch to maintain said air hose in an expanded configuration.

6. The apparatus of claim 5 wherein said mixing apparatus is operated at an internal system pressure not greater than about 20 pounds per square inch.

7. The apparatus of claim 4 including:

said resilient chemical hose having a hose angle adjacent respective pinch points on both sides of the pump, said hose angle with a value in the range of about 10 degrees to about 30 degrees; and said resilient air hose having a hose angle adjacent respective pinch points on both sides of the pump, said hose angle with a value in the range of about 10 degrees to about 30 degrees.

8. The apparatus of claim 3 wherein said loading assembly of said at least one chemical pump includes:

a slide plate mounting said hydraulic motor for moving a load axis defining the location of said motor, said roller plate and said rollers in selected positions for collapsing said hose a variable amount with said rollers;

a cross bar affixed to said slide plate or moving said load axis relative to a center axis of said pump; and a pneumatic cylinder having a shaft affixed to said across bar for moving said slide plate and positioning said load axis relative to said pump axis.

9. The apparatus of claim 8 wherein said loading assembly of said air pump includes:

a slide plate mounting said hydraulic motor of said air pump for moving a load axis defining the location of said motor, said roller plate and said rollers in selected positions for collapsing said hose a variable amount with said rollers;

a cross bar affixed to said slide plate for moving said load axis relative to a center axis of said pump; and a pneumatic cylinder having a shaft affixed to said cross bar for moving said slide and positioning said load axis relative to said pump axis.

10. The apparatus set forth in claim 9 wherein both said pneumatic cylinder of said at least one chemical pump and said pneumatic cylinder of said air pump each include;

a pneumatic supply line with a pneumatic pressure regulator for providing a pneumatic pressure to said pneumatic cylinder for forcing said shaft of said pneumatic cylinder to provide a first position wherein said rollers perform a pumping action; and a shop air line separate from said pneumatic supply line for providing a shop air pressure greater than said pneumatic pressure for forcing said shaft to achieve a second position unload wherein said rollers are released from said pumping action.

11. The apparatus of claim 1 wherein said premix unit is carried by said component support plate and includes:

an air feed device connected to an inlet end of said chemical supply line for adding air to said chemical substance within said chemical supply line;

a premix channel having a premix inlet for passage of said chemical substance and said air from said air feed device into said channel and a premix outlet for discharging said air-chemical mixture into a mixture supply line;

a plurality of mix balls loosely placed within said premix channel forming a progression of orifices and expansion chambers between said premix inlet and said premix outlet to provide said air-chemical mixture; and a front cover plate and a back cover plate of said premix unit affixed at opposite sides of said component support plate at the same location to enclose at least said premix channel and said air feed device to an inside of said premix unit.

12. The apparatus of claim 11 wherein said air feed device includes an air injector, said air injector being configured with an injector cutout channel for feeding air into said chemical substance at two spaced apart locations.

13. The apparatus of claim 12 wherein said premix unit includes a chemical feed device including:

a chemical feed line nozzle extending from another chemical feed line into said premix channel; and a feed ball having a bore to receive said nozzle and a plurality of apertures for discharging another chemical substance into said premix channel.

14. The apparatus of claim 1 wherein said component support plate mounts said foamer which includes:

a rear cover plate affixed to a first side of said component support plate having a plurality of tabs positioned and arranged to the inside of said foamer at a first interface;

a front cover plate affixed to a second side of said component support plate and carrying an internal fixed rotor also having a plurality of tabs to the inside of said foamer at a second interface;

a rotor plate affixed to the inside of said foamer having a plurality of tabs positioned and arranged at said first interface and meshing with said tabs of said rear cover and a plurality of tabs at said second interface meshing with said tabs of said internal fixed rotor;

a foamer hydraulic motor carried by said front cover plate having a rotor core assembly for supporting and rotating said rotor plate within said foamer; and said tabs of said rotor, said front cover and said fixed rotor providing mechanical agitation and shearing action to said air-chemical mixture at said first and second interfaces within said foamer so that said foam substance is generated within said blending foamer to be discharged from said foamer into said foam discharge line.

15. The apparatus of claim 14 wherein said rotor core assembly includes a rotor attachment fixture attached to a motor shaft along a foamer motor axis of said foamer motor for carrying said rotor suspended to the inside of said blending foamer so that a rotor axis coexists with said motor axis.

16. The apparatus of claim 15 wherein said tabs of said rotor at said first and second interfaces are arranged in a plurality of circular arrays with each circular array having its center offset an equal offset distance in the same direction with respect to said rotor axis for generating an eccentric mixing motion of said tabs with respect to the tabs of said front plate and said internal fixed rotor.

17. The apparatus of claim 1 wherein said apparatus includes:

a first hydraulic motor of said at least one chemical pump located near and operational with a first proportional flow valve and a first speed detector for monitoring a first rotational speed of said first motor;

a second hydraulic motor of said air pump located near and operational with a second proportional flow valve and a second speed detector for monitoring a second rotational speed of said second motor;

a third hydraulic motor of said blending foamer located near and operational with a third proportional flow valve and a third speed detector for monitoring a third rotational speed of said third motor; and said control system including a programming logic controller having an electrical control panel for providing electrical flow valve control signals to said flow valves to set respective rotational speeds of said hydraulic motors, wherein said consistency of said chemical compound is selectively controlled.

18. The apparatus of claim 1 wherein said support plate mounts said at least one chemical pump which comprises:

a first chemical pump formed within said support plate at a first location for receiving a first liquid chemical substance from a first respective chemical feed line and pumping said first chemical substance into a first respective chemical feed line supported by said plate;

a second chemical pump formed within said support plate at a second location for receiving a second liquid chemical substance from a second respective chemical feed line and pumping said second chemical substance into a second respective chemical feed line also supported by said plate; and said first and second chemical pumps each having a respective rotational speed for individually pumping first and second quantities of each respective chemical substance through each respective chemical feed line to said premix unit.

19. The apparatus of claim 1 wherein said component support plate houses said mechanical components, said component support plate has a thickness of about 2.5 inches, a width of about 2 foot and is supported by said first end enclosure to extend to a height of about 7 foot, said support plate including generally circular cutouts for housing mechanical elements of said mechanical components apparatus.

20. A coating system for uniformly coating a web sheet with a coating compound while said web is traveling along a path comprising:

a coating machine having a mixing apparatus including a dispenser assembly having a dispensing opening a control mechanism for controlling movement of said web and a support assembly for supporting said web during movement along said path;

a low pressure pumping system for supplying an air-chemical mixture through a mixture supply line;

said low pressure pumping system including a plurality of peristaltic pumps and each said pump being operated for receiving a fluid substance through a supply line and discharging said fluid substance into said mixture supply line;

a blending foamer of said mixing apparatus having a foamer inlet for receiving said air-chemical mixture from said mixture supply line, said blending foamer transforming said fluid substances into a chemical compound having a consistency of a foam substance, and said foamer having a foamer outlet for discharging said chemical compound into a foam discharge line for piping said compound to said dispenser assembly of said coating machine; and a mixing apparatus control system integral with said coating machine control mechanism for controlling said consistency of said foam substance of said compound, wherein said system provides said coating without generally wetting said fabric.

21. The system of claim 20 wherein said pumping system includes:

a component support plate for at least partially housing mechanical components of said pumping system;

a first chemical pump formed at least in part within said plate and operated at a first rotational speed for receiving a first liquid chemical substance from a first chemical supply line and pumping said substance into a first chemical feed line supported by said plate;

an air pump formed at least in part within said plate and operated at a second rotational speed for receiving air from an air supply line and pumping said air into an air feed line; and a premix unit carried by said plate for receiving at least one chemical substance from said at least one chemical feed line and said air from said air feed line to initially mix said first chemical with said air to form said air-chemical mixture at a predetermined mix ratio based on said rotational speeds, said premix unit discharging said mixture into a foamer supply line; and said mixing control system providing at least said first and second rotational speeds and a third rotational speed of said foamer, each one relative to the other, for controlling said consistency of said foam substance.

22. The system of claim 21 wherein said predetermined mix ratio is defined by the volume of said air divided by the volume of said first chemical substance being pumped per unit of time, said mix ratio being in a range from about 2/1 to about 6/1.

23. The system of claim 21 including:

a second chemical pump formed at least in part within said plate and operated at a fourth rotational speed for receiving a second liquid chemical substance from a second chemical supply line and pumping said substance into a second chemical feed line supported by said plate;

said premix unit also receiving said second chemical substance from said second chemical feed line to initially mix said first and second chemical substances with said air to form said air-chemical mixture; and said control system also providing said fourth rotational signal to combine with said first, second and third rotational signals for further controlling said consistency of said foam substance.

24. The system of claim 23 wherein said first and second chemical pumps each including:

a resilient chemical hose for connecting said chemical supply line with said chemical feed line and containing said chemical substance;

a hose support member affixed to said component support plate to receive said hose in a position for pumping said chemical substance;

a plurality of rollers carried by a roller plate for collapsing said hose against said hose support member to force said chemical substance through said resilient hose from said chemical supply line to said chemical feed line;

a hydraulic motor connected to said roller plate for rotating said roller plate at a respective rotational rate to provide a pumping action of said chemical pump;

a loading assembly for controlling the amount of said collapsing of said hose to provide a predetermined volume of said chemical substance being pumped for each revolution of said chemical pump; and a front cover plate and a rear cover plate of said chemical pump, both said plates being affixed to said component support plate to enclose said hose and said plurality of rollers to form a respective peristaltic pump being either one of a first peristaltic pump for a first chemical pump and a third peristaltic pump for a second chemical pump.

25. The system of claim 24 wherein said air pump includes:

a resilient air hose connecting said gas supply line with said air feed line and containing said air;

a plurality of rollers carried by a roller plate for collapsing said hose to force said air through said resilient hose from said air supply line to said air feed line;

a hydraulic motor connected to said roller plate for rotating said roller plate at said second rotational speed to provide a pumping action by said air pump;

a loading assembly for controlling the amount said hose is collapsed by said rollers to provide a predetermined volume of said air being pumped for each revolution of said air pump; and a front cover plate and a back cover plate of said air pump both affixed to said component support plate to enclose at least said hose and said plurality of rollers of said air pump to form a second peristaltic pump.

26. The system of claim 25 wherein said loading assemblies each includes:

a slide plate affixed to said hydraulic motor for moving a load axis of said motor, said roller plate and said rollers into a position with respect to a pump center axis for collapsing said hose with said rollers;

a cross bar affixed to said slide plate for moving said load axis relative to said pump center axis; and an air cylinder having a shaft affixed to said cross bar for positioning said load axis relative to said pump center axis for varying the amount of collapsing of said hose by said rollers and thereby the amount of pumping action.

27. The apparatus set forth in claim 26 wherein both said pneumatic cylinders of said chemical pumps and said pneumatic cylinder of said air pump each include;

a pneumatic supply line with a pneumatic pressure regulator for providing a pneumatic pressure to said pneumatic cylinder for forcing said shaft of said pneumatic cylinder to provide a first position wherein said rollers perform a pumping action; and a shop air line for providing a shop air pressure greater than said pneumatic pressure for forcing said shaft to achieve a second position wherein said rollers are released from said pumping action.

28. The system of claim 25 including:

said resilient chemical hose of both said first and second chemical pumps having a first inlet pressure maintained at a location adjacent a first pinch point at a low value of about 5 pounds per square inch to maintain said hose of said chemical pump in an expanded configuration; and said resilient air hose of said air pump having a first inlet pressure maintained at a location adjacent a first pinch point at a low value of about 5 pounds per square inch to maintain said air hose in an expanded configuration.

29. The system of claim 23 wherein all said lines and hoses are each operated to have an internal pressure not greater than about 20 pounds per square inch.

30. The system of claim 21 wherein said premix unit includes:

an air feed device located adjacent an end of said first chemical feed line for adding air to said chemical substance;

a premix channel having an premix inlet and a premix outlet;

a plurality of mixing balls loosely placed within said premix channel forming a progression of orifices and expansion chambers between said premix inlet and said premix outlet to provide said air-chemical mixture; and a front cover plate and a back cover plate of said premix unit both affixed to said component support plate to enclose said premix channel and said air feed device to an inside of said premix unit.

31. The system of claim 30 wherein said premix device includes an air injector of said air feed device configured with an injector outlet and an injector cutout channel and a wedge portion for feeding air into said chemical substance at two spaced apart locations.

32. The system of claim 30 including a second chemical feed device having a second chemical feed line nozzle attached to the end of said second chemical feed line, said feed line nozzle having a feed ball attached for injecting said second chemical substance into said premix channel through feed bores formed in said feed ball.

33. The system of claim 21 wherein said blending foamer is formed at least in part within said plate and includes:

a rear cover affixed to a first side of said component support plate having a plurality of tabs at the location of a first interface to the inside of said foamer;

a front cover affixed to a second side said component support plate;

a fixed rotor carried by said front cover to the inside of said foamer having a plurality of tabs at the location of a second interface to the inside of said foamer;

a rotating rotor mounted to the inside of said foamer having a plurality of tabs on one rotor surface meshing with the tabs of said rear cover at said first interface and a plurality of tabs on the other rotor surface meshing with said tabs of said front cover at said second interface;

a foamer hydraulic motor carried by said front cover and having a rotor core assembly for supporting said rotor within said foamer and for rotating said rotor at said third rotational speed within said foamer, wherein mechanical agitation and shearing action supplied to said air-chemical mixture within said foamer provides said foam substance to be discharged from said foamer into said foam discharge line.

34. The system of claim 31 wherein the rotor core assembly includes a rotor attachment fixture carried by a foamer motor shaft of said foamer motor, said rotor attachment fixture supporting said rotor for rotating said rotor freely within said foamer.

35. The system of claim 31 wherein said rotor is mounted to said rotor core assembly to provide an eccentricity to the rotational motion of said rotor, wherein said tabs of said rotor reciprocate radially with respect to said tabs of both said front cover plate and said rear cover plate during rotation of the rotor for enhancing said mechanical agitation and said shearing action imparted to said gas-chemical mixture.

36. The system of claim 21 wherein said system includes:

a first hydraulic motor of said first chemical pump associated with a first proportional flow valve and a first speed detector for monitoring a first rotational speed of said first motor;

a second hydraulic motor of said air pump associated with a second proportional flow valve and a second speed detector for monitoring a second rotational speed of said second motor;

a third hydraulic motor of said blending foamer associated with a third proportional flow valve and a third speed detector for monitoring a third rotational speed of said third motor; and said control system including a programming logic controller of said coating machine with an electrical control panel for providing electrical control signals to said flow valves to set relative rotational speeds of said hydraulic motors, being each rotational speed relative to another rotational speed, wherein said consistency of said chemical compound is controlled to achieve said predetermined mix ratio.

37. A coating system for uniformly coating a web sheet with a coating compound while said web is traveling along a path comprising:

a coating machine including a control mechanism, a dispenser assembly having a dispenser opening and a support assembly for supporting said web along said path;

a component support plate for at least partially housing mechanical components of a mixing apparatus;

a plurality of peristaltic pumps of said mixing apparatus being formed at least in part within said plate and each being operated for receiving a fluid substance through a supply line and discharging said fluid substance at a relatively low pressure into a feed line;

a blending foamer of said mixing apparatus formed at least in part within said plate for receiving at an inlet each fluid substance and transforming said fluid substances into a chemical compound, said chemical compound having a consistency of a foam substance to be discharged at an outlet into a foam discharge line for piping said foam substance to said dispenser assembly of said coating machine;

a control system integral with said control mechanism for controlling said consistency of said foam substance, wherein said coating system has a fast changeover from a first coating compound to a second coating compound, said changeover being realized by stopping the operation of at least one pump, changing the fluid supplied to said at least one pump and restarting said at least one pump.

38. A coating machine for applying a coating compound to a web sheet which travels through said machine along a path between first and second spaced sides, said coating machine including a mixing apparatus for mixing said coating compound, a coating table assembly for supporting said web and a dispenser assembly with a coating dispenser opening between said first and second sides which applies said coating compound onto said web traveling along said path, said mixing apparatus comprising:

a component support plate associated with said coating machine for at least partially housing mechanical components of said mixing apparatus;

a chemical pump for receiving a chemical substance from a chemical supply line and pumping said substance into a chemical feed line;

an air pump for receiving air from an air supply line and pumping said air into an air feed line;

a blending foamer for receiving a mixture of said air and said chemical substance and blending said mixture within said blending foamer to form said coating compound into a consistency to be discharged into a foam discharge line for transfer to said dispenser assembly of said coating machine: and at least one of said pumps and said blending foamer being formed at least in part within said component support plate.

39. The apparatus of claim 38 wherein said chemical pump is formed at least in part within said component support plate.

40. The apparatus of claim 38 wherein said air pump is formed at least in part within said component support plate.

41. The apparatus of claim 38 wherein said blending foamer is formed at least in part within said component support plate.

42. A mixing apparatus used with a coating machine for applying a coating compound to a web of a fabric, which travels through said machine along a path between first and second spaced sides of said machine, said coating machine including a coating table assembly for supporting said web and a dispenser assembly with a coating dispenser opening between said first and second sides which applies said coating compound onto said fabric traveling along said path, and said mixing apparatus including a chemical pump for receiving a chemical substance from a chemical supply line and discharging said substance into a chemical feed line, an air pump for receiving air from an air supply line and discharging said air into an air feed line and a blending foamer for receiving a mixture of said chemical substance from said chemical feed line and said air from said air feed line and blending said mixture into said coating compound, wherein said chemical and air pumps include:

a resilient hose for connecting a respective supply line with a respective feed line within each one of said pumps;

a plurality of rollers carried by a rotating roller plate of each one of said pumps for sequentially collapsing said hose to provide a pumping action;

a hydraulic pump for rotating said roller plates; and a loading assembly between said roller plates and said support plates for controlling the amount of collapsing of said hose to provide a controlled volume being discharged from said pumps for each revolution of said roller plates.

43. The apparatus of claim 42 wherein said loading assemblies each includes:

a slide plate affixed to said hydraulic motor for moving a load axis of said motor, said roller plate and said rollers into a position with respect to a pump center axis for collapsing said hose with said rollers;

a cross bar affixed to said slide plate for moving said load axis relative to said pump center axis; and an air cylinder having a shaft affixed to said cross bar for positioning said load axis relative to said pump center axis to change the amount of collapsing of said hose by said rollers and thereby the amount of pumping action of a respective pump.

44. The apparatus set forth in claim 43 wherein both said pneumatic cylinders of said pumps each include;

a pneumatic supply line with a pneumatic pressure regulator for providing a pneumatic pressure to said pneumatic cylinder for forcing said shaft of said pneumatic cylinder to provide a first position wherein said rollers perform a pumping action; and a shop air line for providing a shop air pressure greater than said pneumatic pressure for forcing said shaft to achieve a second position wherein said rollers are released from said pumping action against said hose.

45. A mixing apparatus used with a coating machine for applying a coating compound to a web sheet which travels through said machine along a path between first and second spaced sides of said machine, said coating machine including a coating table assembly for supporting said web and a dispenser assembly with a coating dispenser opening between said first and second sides which applies said coating compound onto said fabric traveling along said path, and said mixing apparatus including a chemical pump for receiving a chemical substance from a chemical supply line and discharging said substance into a chemical feed line, an air pump for receiving air from an air supply line and discharging said air into an air feed line and a blending foamer for receiving a mixture of said chemical substance from said chemical feed line and said air from said air feed line and blending said mixture into said coating compound, wherein said blending foamer includes:

a rear cover having a plurality of tabs;

a front cover having a plurality of tabs:

a rotor carried within said foamer and rotated by a foamer hydraulic motor connected to one of said spaced sides;

said rotor having a first plurality of rotor tabs on one rotor surface meshing with the tabs of said rear cover at a first interface and a second plurality of rotor tabs spaced away from said first rotor surface meshing with said tabs of said front cover at a second interface; and said rotor being rotated by said hydraulic motor for providing an eccentricity to the rotational motion of said rotor, wherein said rotor tabs of said rotor reciprocate radially with respect to said tabs of both said front cover plate and said rear cover plate during rotation of the rotor for enhancing said mechanical agitation and said shearing action imparted to said coating compound.

46. The apparatus of claim 45 including a rotor core assembly for carrying said rotor within said foamer, said core assembly being affixed to a shaft of said foamer hydraulic motor to rotate with said shaft for providing said eccentricity to said rotor.

* * * * *